United States Patent [19]

Treffner et al.

[11] 4,016,785

[45] Apr. 12, 1977

[54] ROLL SLITTER

[76] Inventors: Charles Treffner; Peter Treffner, both of 43 Yangoora Road, Belmore, Sydney, New South Wales, Australia, 2192

[22] Filed: Sept. 26, 1975

[21] Appl. No.: 617,268

[30] Foreign Application Priority Data

Sept. 30, 1974 Australia ..... 9083/74

[52] U.S. Cl. ..... 82/53; 82/101

[51] Int. Cl.² ..... B23B 37/00; B23B 3/04

[58] Field of Search ..... 82/46, 47, 52, 53, 86, 82/101

[56] References Cited

UNITED STATES PATENTS

| | | | |
|---|---|---|---|
| 871,828 | 11/1907 | Sexton | 82/101 |
| 2,015,877 | 10/1935 | Thompson | 82/46 A |
| 3,174,369 | 3/1965 | Denk et al. | 82/101 |
| 3,218,894 | 11/1965 | Chow | 82/101 |
| 3,233,306 | 2/1966 | Kessel et al. | 82/46 X |
| 3,350,967 | 11/1967 | Gerstein | 82/46 |
| 3,752,024 | 8/1973 | Judelson | 82/86 |

*Primary Examiner*—Harrison L. Hinson
*Attorney, Agent, or Firm*—Beveridge, DeGrandi, Kline & Lunsford

[57] ABSTRACT

Apparatus for cutting rolls of sheet material is provided with a pair of longitudinally stationary parallel knife blades positioned on opposite sides of a band saw blade which moves longitudinally to remove swarf from between the knife blades. The knife blades are supported on a blade carried band which is held under tension between spaced apart points on a mounting frame. A longitudinal gap in the knife blade exposes a section of the band saw blade to cut the core of a roll of sheet material.

10 Claims, 7 Drawing Figures

ROLL SLITTER

The present invention relates to a machine for the transverse cutting of an elongated roll of material into axially shorter rolls. Although this type of machine is applicable in many fields such as the conversion of paper or cloth, the present invention has particular relevance to the cutting or slitting of rolls of plastic film.

In the cutting of this material, previous roll slitting machines have mounted the roll on an expanding mandrel which was then rotated while a cutter was simultaneously moved transversely of the axis of rotation into the roll to perform the cutting action. This moveable cutter was usually in the form of either a single rotating disc or a linear knife blade, but in both instances the slitting operation had several disadvantages.

One of the most troublesome deficiencies in previous machines of this type a tendency of the plastic material to become overheated due to friction between the edges of the cut and the sides of the cutting blade. The heating effect was aggravated by a build up of swarf from the cutting surface which then tended to make the cutting blade bind against the sides of the cut as it moved through the roll.

In one particular machine an attempt was made to ameliorate this difficulty by providing a cutter which consisted of a pair of axially spaced discs located on one side of the elongated roll to be cut. Diametrically opposite the cutter there was located a circular serrated saw which was maintained in alignment with the space between the rotating discs. As the cutter moved into the roll of plastic film the serrated saw was moved an equal amount such that the waste material which was generated between the cutter blades was removed from the cut by the action of the saw. With this arrangement great care must be taken to keep the serrated blade from moving ahead of the cutter, or from lagging so far behind that waste material builds up between the two blades. This is aggravated by variations in the thickness, hardness, spacing or tension of successive layers of rolled material, or any of the other factors which may introduce inhomogenieties into a single roll. In addition to this, it is difficult to ensure that the serrated blade tracks exactly in register with the cutters due to unwanted movement of the peripheral edge of an inherently resilient, centrally supported disc.

A further development in the field of roll slitting machines also utilised a pair of axially spaced cutting discs but incorporated in the space between them, a chain saw which rotated with the cutting disc such that the swarf or waste material was removed as soon as it was generated. Although this machine served to reduce the effect of frictional heating of the plastic material at the cutting face during the cutting operation, it was still plagued by several disadvantages. Firstly, the disc arrangement lacked rigidity at the cutting surface and as the cut progressed deeper into the roll this lack of rigidity allowed the blades to wander with the result that an uneven surface was generated on the ends of the finished rolls. Secondly, the relatively large surface area of the discs tended to rub against the two faces of the cut so as to produce a significant amount of frictional heating of the faces.

It is an object of the present invention to provide a roll slitting machine which will substantially ameloriate the abovementioned disabilities of the prior art.

A further problem arose when the cut reached the rigid cylindrical core on which the film was wound and which is usually made of a material such as cardboard and is therefore more abrasive than the plastic material surrounding it. In this respect as the cutter blades moved into the central core they tended to be blunted by the harder material. The provision of the rotating chain saw assembly did not improve the position because it was necessary, as pointed out earlier, to ensure that the blade did not extend further into the plastic material during the cutting process than the cutter blades themselves. If this occurred, the plastic would be torn from the roll rather than neatly sliced. To cut the roll completely through, it then became necessary to remove the cutter assembly and substitute a further saw which would complete the operation of severing the core.

Thus a further object attained by preferred embodiments of the invention is to provide for more efficient cutting of the roll core than has been possible heretofore.

According to the present invention there is provided apparatus for slitting a wound roll of sheet material into two parts comprising:

- means for mounting and rotating said roll about its axis,
- cutting means comprising a pair of parallel, spaced apart, rectilinear knife blades disposed in planes perpendicular to the axis of said roll, and a band saw blade disposed between said knife blades,
- means to move said saw blade longitudinally with respect to said knife blades so as to remove swarf from between said knife blades,
- knife blade support means including a mounting frame and a blade carrier band affixed to and held in tension between two spaced apart points on the mounting frame, said knife blades being fixedly mounted on said blade carrier band,
- means for providing relative movement between said mounting frame and said roll such that said cutting means comes into cutting engagement with said roll.

A preferred embodiment of the present invention will now be described by way of example only with reference to the accompanying drawings in which.

Figure 1:
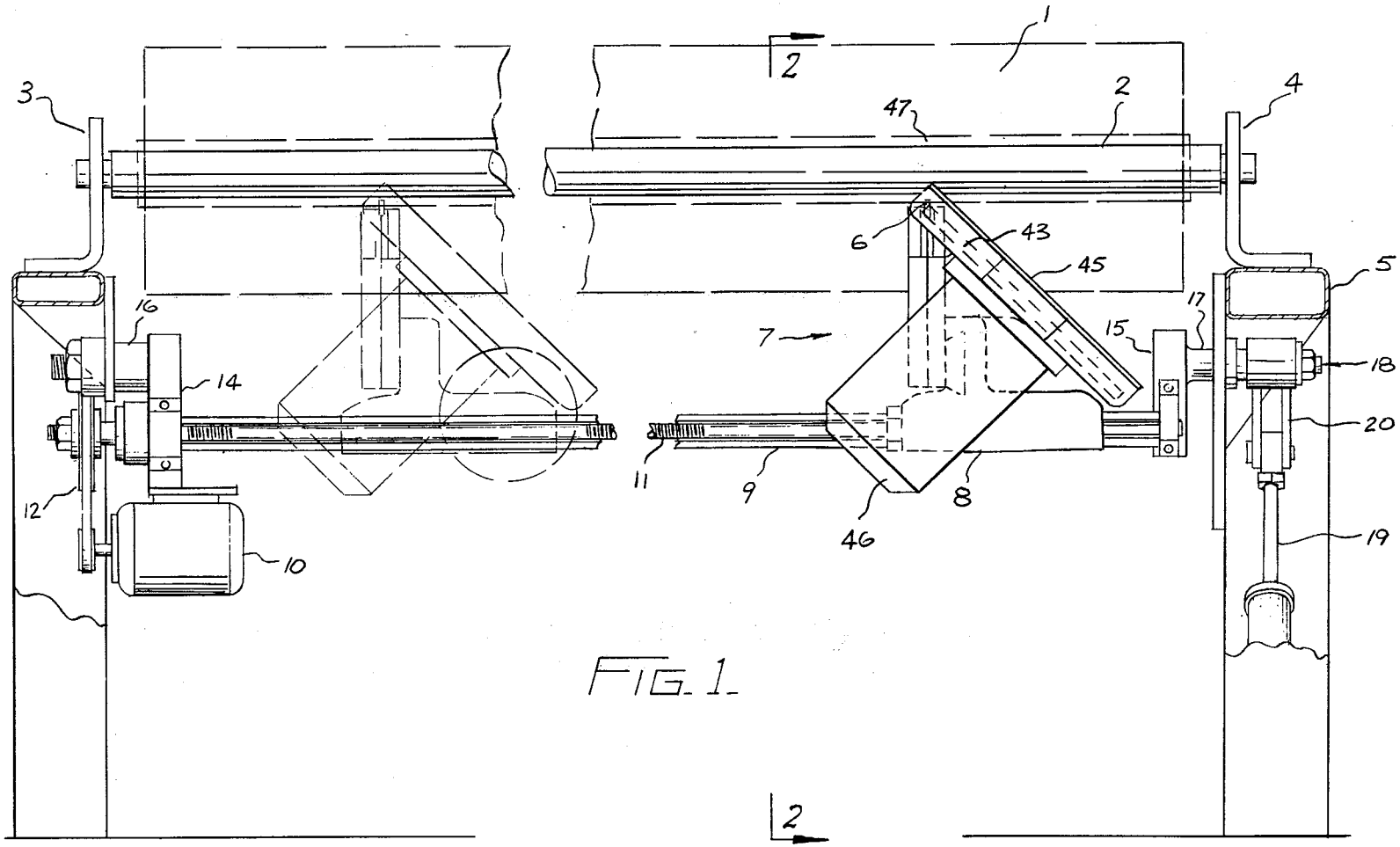
FIG. 1 is a partly sectioned side elevation of a roll slitting machine according to the present invention showing the knife blades in a position of maximum engagement with the roll.

Referring to the drawings, a plastic roll 1 is located upon an expanding mandrel 2 which in turn is mounted for rotation about its longitudinal axis by two end supports 3 and 4 fixed to a machine frame 5. The mandrel 2 is rotated by means of a motor and gear box assembly (not shown). A knife blade assembly 6 is mounted upon a carriage generally indicated at 7 which may be positioned longitudinally with respect to the roll through movement of the saddle 8 on slide 9. Motion of the carriage 7 along the slide 9 is effected by an electric motor 10 which drives a feed screw 11 by means of a belt and pulley assembly 12.

The slide 9 is mounted between two crank webs 14 and 15 which in turn are connected to two crank shafts 16 and 17 respectively. These shafts 16 and 17 are journalled to permit the carriage 7 to rotate about pivot point 18. The amount of carriage rotation, and thereby the feed of the knife blades through the roll is controlled by means of a hydraulic ram 19 which rotates the crank shaft 17 by means of a connecting rod 20 which is rigidly attached to the crank shaft 17.

Figure 5:
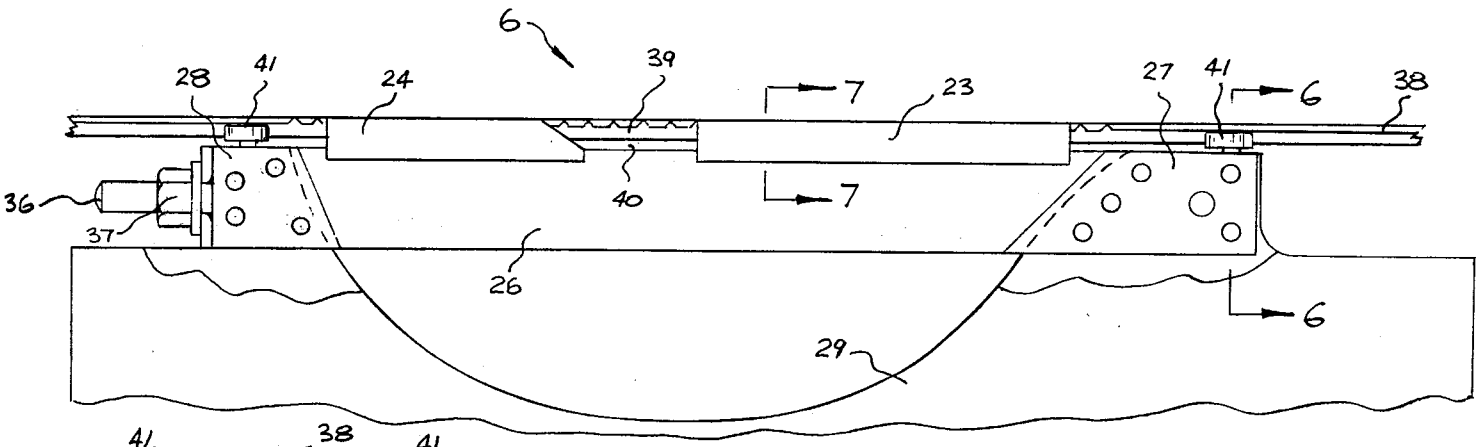
FIG. 5 is an enlarged side elevation showing the knife blade assembly used in the machine illustrated in the previous drawings.
Figure 7:
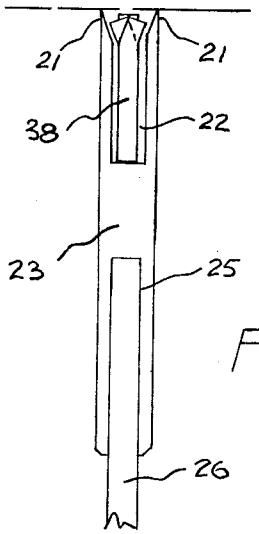
FIG. 7 is an enlarged section taken on line 7—7 of FIG. 6.
Figure 6:
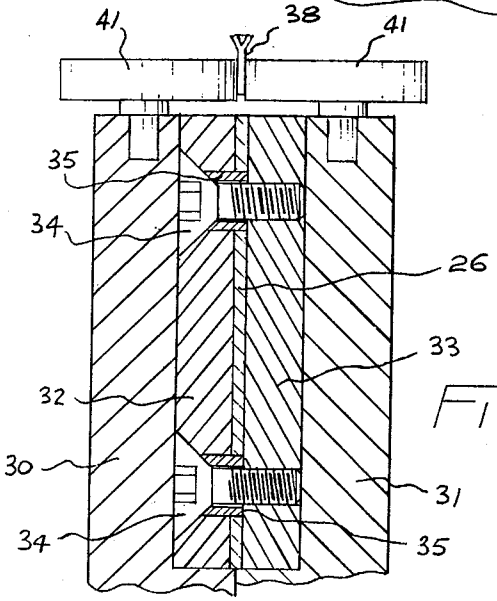
FIG. 6 is an enlarged section taken on line 6—6 of FIG. 5.

Details of the knife blade assembly 6 can best be seen in FIGS. 5, 6 and 7. In this embodiment, the two knife blades 21 are formed by cutting an axially extending groove 22 along two cutter elements 23 and 24. A similar groove 25 is also formed in the cutter elements 23 and 24 to locate these elements separately upon a spring steel blade carrier 26 as shown in FIGS. 5 and 7. The blade carrier 26 is held in tension between two end posts 27 and 28 on a bowed mounting frame 29 which is constructed in two halves 30 and 31. As best shown in FIG. 6, the blade carrier 26 is firmly gripped between two clamping plates 32 and 33 by means of clamping screws 34 and sleeves 35. The tensile force transferred to the clamping plates 32 and 33 is then resisted by abutments on the mounting frame end post 27. A similar mounting arrangement is employed at the opposite end post 28 with the exception that the clamping plates are provided with a threaded extension 36 permitting tensioning of the blade carrier 26 by means of an adjusting nut 37.

A band saw blade 38 is positioned in the groove 22 formed in the cutter elements 23 and 24, but as shown in FIG. 7, the blade 38 does not extend beyond the cutting edges of the knife blades 21. If this were to occur, it would result in a tearing effect rather than a slicing action as the cutter elements move into the roll. However, a portion 39 of the band saw blade 38 is exposed in the gap 40 between the cutter elements 23 and 24 which are spaced apart along the carrier 26. The function of this exposed portion 39 will be described later.

The band saw blade 38 is in the form of an endless loop which is guided by four rollers 41 and passes over two pulleys 42 and 43 located in housings 44 and 45 respectively. Power is supplied to the saw by means of an electric motor 46 which, together with the mounting frame 29 forms part of the carriage 7 and rotates with it during the cutting operation.

As mentioned earlier, a serious disadvantage associated with roll slitting machines previously known was the inability of the knife blades to cut through the central core 47 of the plastic roll 1 without unduly shortening the working life of the cutting edges. The preferred embodiment of the invention which is presently being described incorporates a feature which enables the central core 47 to be severed by means of the band saw blade 38 rather than by the slicing action of the knife blades 21. This has the effect of providing a much faster and neater cut through the core 47 while at the same time preserving the cutting edge of the knife blades from undesirable abrasion.

Figures 3, 4:
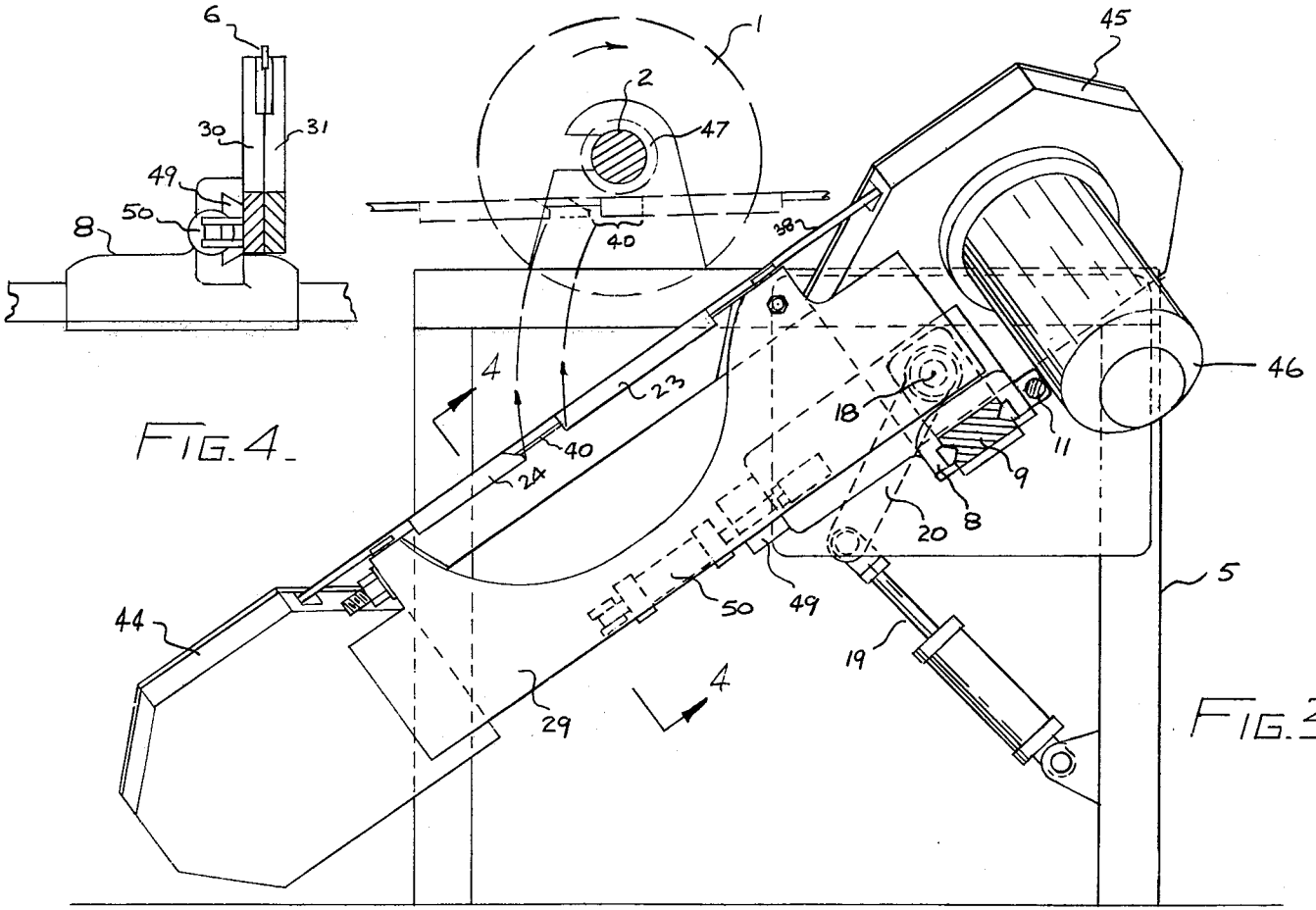
FIG. 3 is a section similar to that shown in FIG. 2 but showing the knife blades in a retracted position.
FIG. 4 is a section taken on line 4—4 of FIG. 3.

When the cutter elements 23 and 24 reach the position shown in the broken line portion of FIG. 3, it will be observed that the cutter element 23 is almost in contact with the core 47, and any further rotation of the carriage 7 would force the knife blades 21 into the core material. To avoid the need for doing this and causing undesirable blade wear, the present embodiment of the invention provides a means of shifting the entire carriage 7 so that the gap 40 containing the exposed portion 39 of the saw blade 38 is moved into register with the core 47 as shown by the dotted portion of FIG. 3. The shifting operation is performed by means of a transverse slide 49 and hydraulic cylinder 50 which will displace the carriage 7 relative to the saddle 8.

Figure 2:
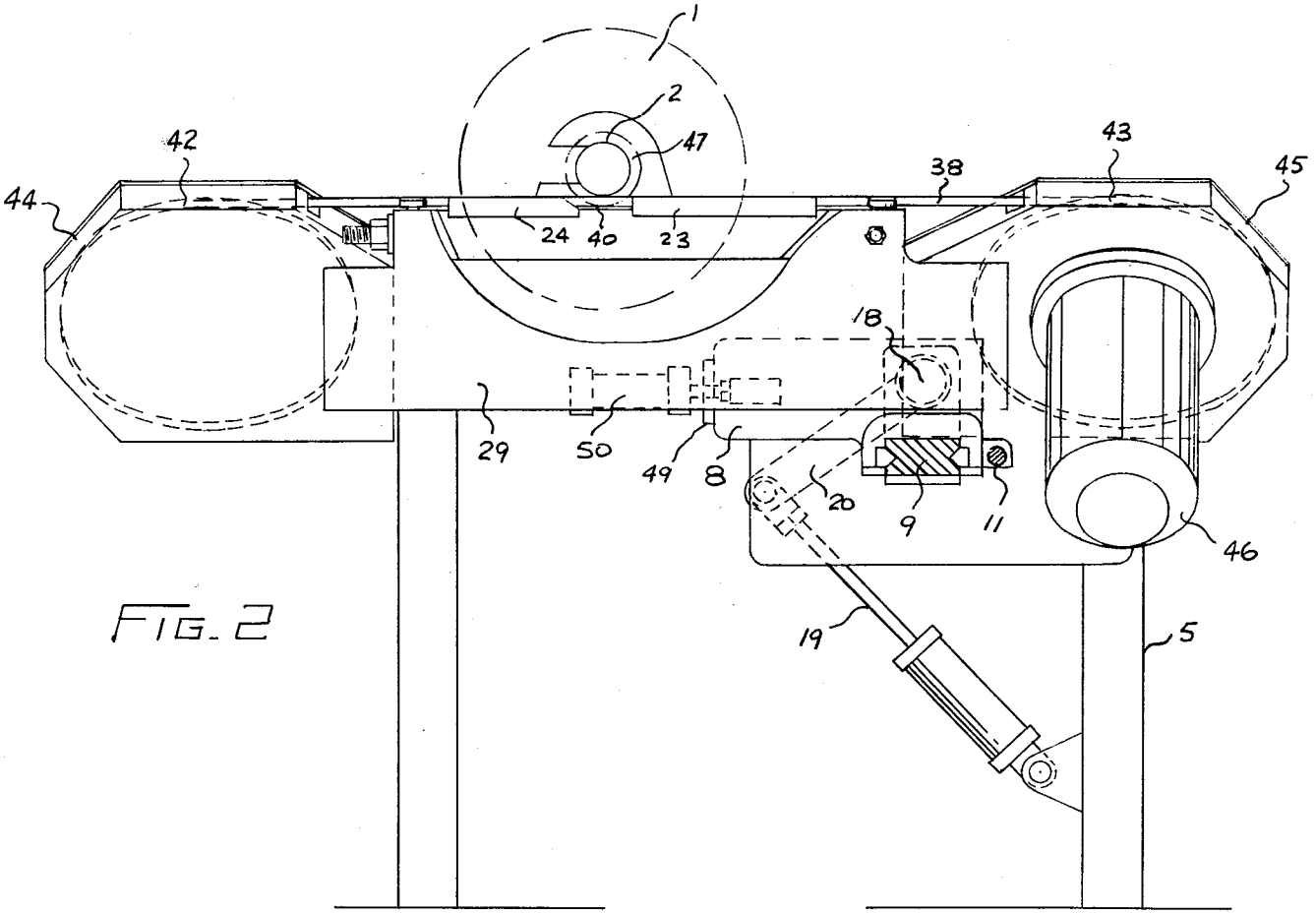
FIG. 2 is a section taken on line 2—2 of FIG. 1.

With the carriage 7 in the shifted position, further rotation will bring the exposed portion 39 of the saw blade 38 into cutting engagement with the core 47 allowing rapid completion of the roll slitting operation; the carriage 7 finally assuming the position shown in FIG. 2.

It has been found that roll slitting machines using linear cutting knives disposed on either side of a moving saw blade in accordance with the present invention produce a much smoother cut than previous machines employing disc cutters. Not only are linear cutting blades capable of a higher degree of rigidity than their circular counterparts, but also the relatively smaller area of rubbing contact with the sides of the cut reduces the incidence of frictional heating.

The claims defining the invention are as follows:

1. Apparatus for slitting a wound roll of sheet material into two parts comprising:

means for mounting and rotating said roll about its axis, cutting means comprising a pair of parallel, spaced apart, rectilinear knife blades disposed in planes perpendicular to the axis of said roll, and a band saw blade disposed between said knife blades, knife blade support means including a mounting frame, and a blade carrier band affixed to and held in tension between two spaced apart points on said mounting frame, said knife blades being fixedly mounted on said blade carrier band, means to move said saw blade longitudinally with respect to said knife blades so as to remove swarf from between said knife blades, means for providing relative movement between said mounting frame and said roll such that said cutting means comes into cutting engagement with said roll.

2. Apparatus as claimed in claim 1 wherein the cutting edges of said knife blades extend beyond the cutting edge of said saw blade toward the position of a roll on said mounting means.

3. Apparatus as claimed in claim 2 wherein said knife blades are formed upon two cutter elements which are spaced along said blade carrier thereby to provide a gap within which said saw blade is fully exposed.

4. Apparatus as claimed in claim 3 wherein means are provided to index said mounting frame in the direction of said knife blades thereby to bring said gap into register with the core of said roll.

5. Apparatus as claimed in claim 4 wherein said cutting means and said means to move said saw blades are mounted on a carriage which is mounted for rotation about an axis fixed relative to the axis of said roll, rotation of said carriage bringing said cutting means into cutting engagement with said roll.

6. Apparatus as claimed in claim 5 wherein said carriage is mounted upon a slide for longitudinal adjustment relative to said roll.

7. Apparatus as claimed in claim 6 wherein said slide forms the crank pin of a crank shaft, the axis of which defines the axis of rotation of said carriage.

8. Apparatus as claimed in claim 2 wherein a longitudinal portion of said saw blade away from the cutting region of said knife blades is operably exposed and means are provided to cause relative motion between said cutting means and said roll transversely of said roll, thereby to bring said longitudinal portion into register with the core of said roll so as to permit said saw blade to cut said core upon being moved thereinto.

9. Apparatus as claimed in claim 1 wherein a longitudinal portion of said saw blade away from the cutting region of said knife blades is operably exposed and means are provided to cause relative motion between said cutting means and said roll transversely of said roll, thereby to bring said longitudinal portion into register with the core of said roll so as to permit said saw blade to cut said core upon being moved thereinto.

10. Apparatus as claimed in claim 1 wherein said knife blades are formed upon two cutter elements which are spaced along said blade carrier thereby to provide a gap within which said saw blade is fully exposed.

* * * * *